United States Patent [19]

Rogers

[11] Patent Number: 4,802,402

[45] Date of Patent: Feb. 7, 1989

[54] CYLINDER HAVING AN INTERNALLY-DISPOSED DRAIN VALVE

[75] Inventor: Larry K. Rogers, Henderson, Ky.

[73] Assignee: American Standard Inc., Lexington, Ky.

[21] Appl. No.: 930,479

[22] Filed: Nov. 14, 1986

[51] Int. Cl.[4] ..... F01B 3/00

[52] U.S. Cl. ..... 91/268; 91/442; 91/452; 91/468; 92/86

[58] Field of Search ..... 92/79, 86, 87; 91/442, 91/452, 468, 451, 268

[56] References Cited

U.S. PATENT DOCUMENTS

| | | | |
|---|---|---|---|
| 562,039 | 6/1896 | Schmidt | 91/268 |
| 650,263 | 5/1900 | Morrow | 91/442 |
| 1,020,861 | 3/1912 | Walraven | 91/442 |
| 1,228,555 | 6/1917 | Hansen | 91/268 |
| 1,439,854 | 12/1922 | Vincent | 91/442 |
| 1,574,103 | 2/1926 | Michael | 91/442 |
| 1,652,879 | 12/1927 | Standerwick | 92/86 |
| 3,442,290 | 5/1969 | Phillips | 91/468 |

*Primary Examiner*—Robert E. Garrett
*Assistant Examiner*—Thomas Denion
*Attorney, Agent, or Firm*—G. P. Baier

[57] ABSTRACT

A work cylinder having an internally-disposed, automatically-operated drain valve disposed in one or both ends of a housing having a cylinder bore formed therein. A reciprocally-movable piston divides the bore into first and second pressure chambers. A drain chamber formed in one or both ends has a movable plunger member disposed therein. A first passageway allows fluid from the pressure chamber to act on one surface of the plunger. A pilot valve is partially formed on a bottom portion of the plunger and opens when fluid pressure is exhausted from the adjacent pressure chamber. A bias spring acts on the plunger to prevent closing of the drain valve upon initial pressurization of the adjacent chamber. This initial pressurization assists in purging additional moisture from the chamber until a threshold level is exceeded to close the drain valve.

20 Claims, 3 Drawing Sheets

CYLINDER HAVING AN INTERNALLY-DISPOSED DRAIN VALVE

BACKGROUND OF THE INVENTION

This invention relates to a work cylinder having an internally-disposed drain valve and, more particularly, such a cylinder and drain valve configuration where the cylinder is located at a distance from the compressor, reservoir, and drain valve associated with these two devices. An application of such a cylinder, drain valve configuration, located at a distance from the compressor and reservoir, would be that of a railroad situation where a railroad car on which the cylinder is mounted is distant from the locomotive on which the compressor is located. The locomotive also contains the main reservoir which typically has a separate drain valve associated therewith. As compressed air travels from the main reservoir to the distant cars, it further cools and, consequently, more water vapor in the air liquidates. This problem becomes further complicated due to the water causing corrosion, or possibly freezing within the cylinder itself. Moreover, it is not practical to provide an additional drain valve at each car, due to the expense involved in the additional maintenance and installation costs, and the space-constraints that the additional elements would operate under. Adding a separate drain valve to each car further entails the addition of the necessary piping to connect these drain valves to the system, further increasing installation and maintenance costs.

The cylinder location in railroad-type applications further makes the use of a separate drain valve in conjunction with the cylinder impractical, since the cylinder can be the lowest point in the car; and, since the drain valve in a number of instances, would be secured to the car, the valve would be higher than the cylinder and could not effect a draining operation with respect to this lower-disposed cylinder. Furthermore, due to the size of the cylinder, the cylinder itself can act as a reservoir in and of itself, thereby resulting in an increased amount of condensation occurring within the cylinder.

SUMMARY OF THE INVENTION

It is, therefore, an object of the invention to provide a work cylinder having a drain valve configuration integrally formed as an internal part thereof.

It is a further object of the invention to provide such a work cylinder having an internally-disposed drain valve which, by being formed as a single unit, conserves mounting space.

Yet a further object of the invention is to provide such a work cylinder with an internally-disposed drain valve where, with the cylinder being the lowest-mounted device, the drain valve is disposed at the lowest point of the cylinder, thereby serving to efficiently drain moisture from the cylinder.

An even further object of the invention is to provide such a work cylinder having an internally-disposed drain valve which purges moisture from the cylinder everytime the cylinder is cycled.

Still a further object of the invention is to provide such a work cylinder having an internally-disposed rain valve which utilizes fluid pressure introduced into a cylinder chamber for moving the work piston to force moisture out of that chamber, the drain valve initially remaining opened until a predetermined fluid pressure level has built up within the chamber.

Briefly, the invention consists of a cylinder housing having a piston disposed within a bore formed therein, the piston dividing the bore into first and second pressure chambers. A pilot chamber disposed adjacent one of the pressure chambers has a plunger movable therein under the influence of fluid pressure introduced to the one of the pressure chambers, and which is communicated through a first passageway to the pilot chamber. A drain valve is formed partially on the bottom portion of the plunger and operates, when fluid pressure is in the one pressure chamber, to a closed position; and when the one pressure chamber is evacuated, to an open position such that moisture can flow thereover to be purged from the one chamber. A second passageway extends from the pilot chamber to the one pressure chamber at a point below the plunger member. A bias spring acts on the plunger so that the drain valve remains open until a predetermined fluid pressure level is reached in the one chamber; this lower-valued fluid pressure further assisting to purge the pressure chamber of moisture.

DESCRIPTION AND OPERATION

Figure 1:
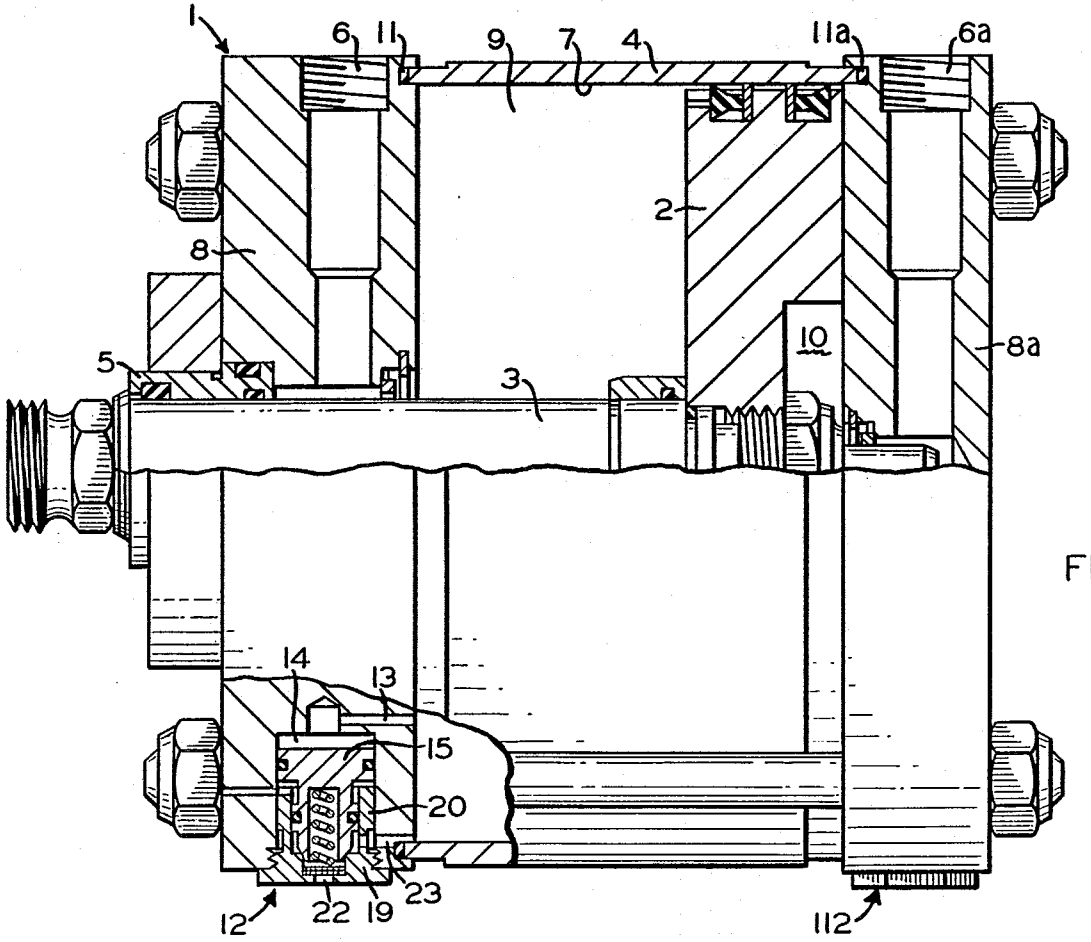
FIG. 1 is an elevational view, partly in section, of a work cylinder with an internally-disposed drain valve constructed in accordance to the invention.

As seen in FIG. 1, the work cylinder 1, with an internally-disposed drain valve shown generally as reference 12, includes a cylinder housing 4 sealed on one end by a first end cap 8, and on the opposite end by a second end cap **8*a*. First and second annular seals 11 and 11*a* seal the respective first and second end caps 8 and 8*a* to the cylinder housing 1, so that a bore 7 is formed in the cylinder housing 1**.

A piston member 2 is reciprocally-movable within the bore 7, and serves to divide the bore 7 into first and second pressure chambers 9 and 10, respectively. First and second pressure openings 6 and **6*a* allow for communication of fluid pressure to the first and second pressure chambers 9 and 10**, respectively.

Extending through one of the first and second end caps (in this embodiment element 8) is a piston rod 3, which is connected on one end to the piston 2 and extends, on the opposite end, outward of the cylinder housing 4 for attachment with a device (not shown) to be operated by the work cylinder 1. A sealed bearing member 5 prevents fluid pressure from escaping around the piston rod 3, and also ensures easy passage of the piston rod 3 therethrough.

As seen in FIG. 1, the drain valve 12 is disposed in the first end cap element 8; however, it can be appreciated that such arrangement will be equally as effective in the second end cap element 8a as well as when disposed in both end caps 8 and 8a of the work cylinder 1. FIG. 1 shows a second drain valve 112, which is identical to drain valve 12 disposed in end cap 8a.

Figure 2:
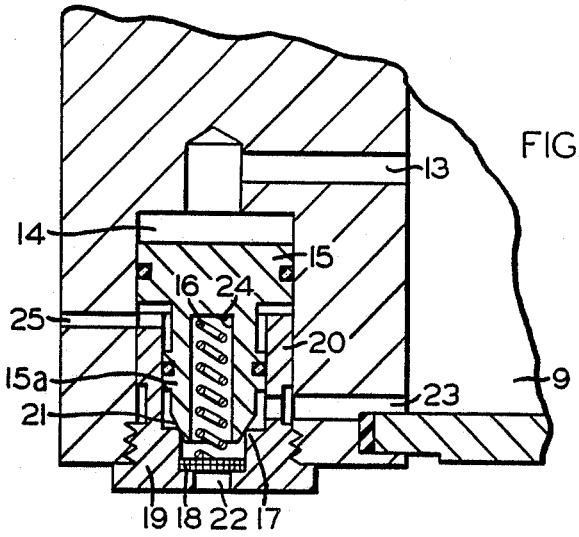
FIG. 2 is an elevational view, in section, of one embodiment of the drain valve portion of the work cylinder with an internally-disposed drain valve.

The drain valve assembly is shown in greater detail in FIG. 2 where a pilot chamber 14, formed in the first end cap 8, is in fluid communication on a top end with the first pressure chamber 9, by way of a first passageway 13. Disposed within the pilot chamber 14, in a sliding, fitted manner, is a plunger member 15, which is movable within the pilot chamber 14 under the influence of fluid pressure communicated thereto from the first pressure chamber 9 over the first passageway 13. The plunger member 15 has a lower portion 15a, which is of a reduced diameter than the portion adjacent the first passageway 13.

A retaining member 19 secures to the first end cap 8, at the bottom side of the pilot chamber 14, to thereby define the lower limit of the pilot chamber 14. The retaining member has an upward-projecting tubular support wall portion 20, into which slidably fits, the lower portion 15a of the plunger member 15. In this manner, it can be appreciated that the plunger member 15 is movable in a guided manner within the pilot chamber 14, as a result of the sliding-fit at both the upper and the lower portions thereof.

In the lowermost position of the plunger member 15, within the tubular support wall portion 20 of the retaining member 19, a valve body portion 21 of plunger member 15 cooperates with a valve seat portion 17, formed adjacent a drain opening 22 of the retaining member 19.

As seen in FIG. 2, the drain valve 12 is disposed on the work cylinder 1 at a point lower than the inner opening of the bore 7, thereby establishing the drain valve as the lowest point in the work cylinder assembly. It can be appreciated that when the work cylinder 1 is installed as, for instance, on a railroad car, the work cylinder 1, by being the lowest-mounted element on the car, then establishes the drain valve 12 as the lowest point on the car so that moisture occurring on the car can be drained therethrough.

The drain opening 22, located at the bottom of the retaining member 19, has a lip portion formed therein in which a screen element 18 is disposed for conventional purposes.

Formed in the first end cap 8, between a low portion of both the pilot chamber 14 and the first pressure chamber 9, is a second passageway 23, through which can pass the moisture that has accumulated in the first pressure chamber 9. This second passageway 23 is closed from exhausting, when the drain valve 12 is in the closed position.

A bias spring 16 is seated within a hollow annular spring chamber 24 formed in the lower portion 15a of the plunger member 15. The bias spring 16 further is caged within the lap portion of the drain opening 22, and acts to urge the plunger member 15 upward, thus opening the drain valve 12 when the fluid pressure in the first pressure chamber 9 is less than a predetermined value.

By operating solely as a function of the fluid pressure level in the first pressure chamber 9, the drain valve 12 is automatic and, therefore, requires no external pilot signals or support devices. It can also be appreciated that the drain valve 12 will operate in a cyclic manner; that is, whenever the work cylinder 1 is pressurized at the opposite end as the drain valve 12, moisture will be purged from the non-pressurized pressure chamber.

A bleed passageway 25 extends from the pilot chamber 14 at a point just above the tubular support wall 20 to atmosphere, and is effective for adjusting the amount of back pressure acting on the plunger member 15 in opposition to the fluid pressure from the first pressure chamber 9 acting through passageway 13 on the upper portion of plunger member 15.

In operation, the work cylinder 1, with the internally-disposed drain valve 12, will be presently discussed under the assumption that there is one drain valve 12, and that this valve 12 is located in the first end cap element 8.

If it is desired to move the piston 2 toward the left-hand end, that is, the first end cap 8 region, from the position shown in FIG. 1, the second pressure chamber 10 is pressurized. At this time, the first pressure chamber 9 is exhausted; therefore, there is no fluid pressure force acting on the plunger member 15 to urge the valve body 21 onto the valve seat portion 17, and the bias spring 16 can then urge the plunger member 15 upward to open the drain valve 12. Moisture which may have been deposited in the first pressure chamber 9, such as, for example, a result of condensation of the fluid pressure introduced into the first pressure chamber 9 during the previous pressurization, is then purged from the first pressure chamber 9 by the combined action of gravity, which causes the moisture to go to the lowest point in the work cylinder 1 adjacent to second passageway 23 and the movement of the piston into the first pressure chamber 9 which, in effect, sweeps moisture to the drain valve 12. The moisture will pass through the second passageway 23, through the open drain valve 12, and out through the drain opening 22.

The plunger member 15 will remain in this upward position until such time as the first pressure chamber 9 is again pressurized and the fluid pressure level therein has exceeded a predetermined threshold level. This predetermined fluid pressure threshold level is selected so that the tension of the bias spring 16 is not overcome initially during pressurization, thereby allowing the drain valve 12 to remain open and utilizing the force of this initial pressurization to further assist in the purging of moisture from the first pressure chamber 9. When this threshold level is exceeded, the drain valve 12 closes and the fluid pressure in chamber 9 acts to move the piston rightward, as shown in FIG. 1. The closing of the drain valve 12 occurs due to the fluid pressure traveling through the first passageway 13 and into the pilot chamber 14. Because the area of the top of the plunger member 15 is greater than the area of the lower portion 15a, the fluid pressure urges the plunger member 15 downward so that the valve body 21 seats on the valve seat portion 17, thus closing the drain valve 12.

Figure 3:
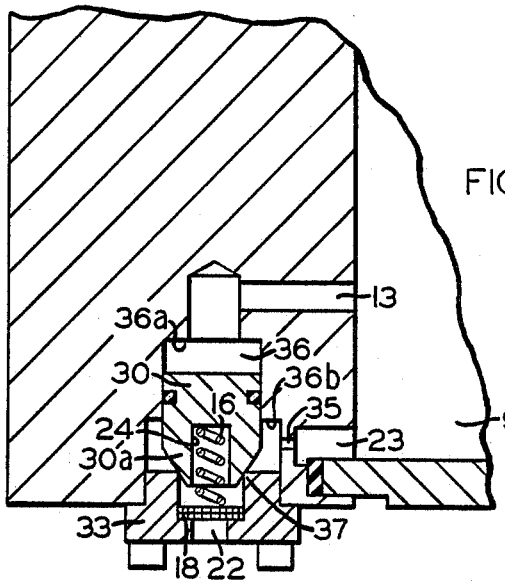
FIG. 3 is an elevational view, in section, of an alternate embodiment of the drain valve portion of the work cylinder with an internally-disposed drain valve.

As seen in FIG. 3, the work cylinder 1, having an alternate configuration for the internally-disposed drain valve 12, utilizes a number of components similar to those used in FIG. 2 and, hence, uses the same reference numbers. Additionally, the drain valve 12 is depicted as being located in the first end cap 8, but it can be equally as effective in the second end cap member 8a as well as in both end cap members 8 and 8a.

As seen in FIG. 3, the pilot chamber 36 is formed, in a graduated manner, with the upper portion being of a uniform diameter plunger member 30 residing in a first graduation 36a, and a tapered lower portion 30a of the plunger member 30 residing in a second graduation 36b of the pilot chamber 36. The tapered lower portion 30*a* of the plunger member 30 forms the valve body portion which, along with a valve seat portion 37 formed at the top rim of the retaining member 33, forms the drain valve 12. The second passageway 23 communicates with this lowest portion of the pilot chamber 36, but it first passes through a restriction 35 formed in the first end cap member 8, between the pilot chamber 36*b* and the second passageway 23.

In operation, the work cylinder 1, with the internally-disposed drain valve shown in FIG. 3, operates significantly in the same manner as the work cylinder 1, drain valve 12 configuration (shown in FIG. 2). In fact, when fluid pressure is exhausted from the first pressure chamber 9, the drain valve 12 opens in the same manner; it is during the pressurization of the first pressure chamber 9 that the operation of the work cylinder 1, drain valve 12 configuration (shown in FIG. 3) differs somewhat from that of FIG. 2.

Upon first pressurization of the first pressure chamber 9, fluid pressure is also communicated to the pilot chamber 36 and through the second passageway 23. A restriction 35 is formed in the second passageway 23 to throttle the flow of fluid pressure from the first pressure chamber 9 to the portion of the pilot chamber 36*a* in which the drain valve is disposed, that being the underside of the plunger member 30. This restriction 35 causes a pressure-drop at the underside of the plunger member 30, so that the pressure at the upper side of the plunger member 30 is greater than that at the lower side at which the bias spring 16 is disposed. This pressure differential forces the plunger member 30 against the force of bias spring 16, onto the valve seat portion 37, thus closing the drain valve 12. After the valve body portion 30*b* has been seated on the valve seat portion 37, air leakage out through the screen element 18 is halted, thus reducing further the pressure acting on the lower, spring side of the plunger 30 so that the plunger member 30 seats even better. However, prior to the valve closing and similar to the operation of the plunger in FIG. 2, the plunger in FIG. 3 does not immediately seat upon pressurization of the first pressure chamber 9, which thereby allows such initial introduction of final pressure thereto to serve to purge moisture from the first pressure chamber 9. Once the fluid pressure level in the first pressure chamber 9 exceeds the predetermined threshold level, the drain valve 12 would then close. The restriction or choke 35 could be inserted in the embodiment of FIGS. 1 and 2.

Figure 4:
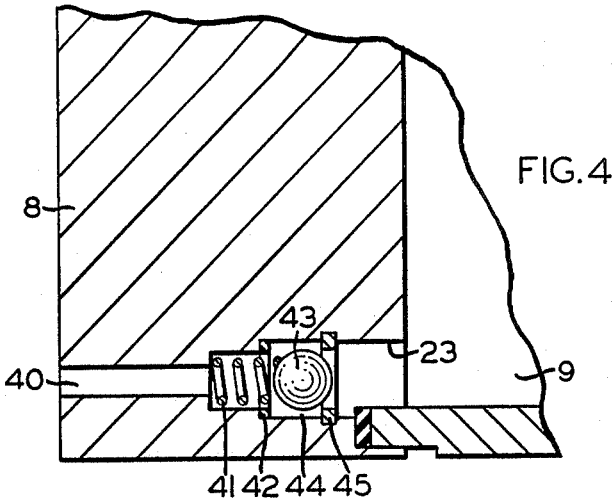
FIG. 4 is an elevational view, in section, of a second alternate embodiment of the drain valve portion of the work cylinder with the internally-disposed drain valve.

As seen in FIG. 4, a second alternate embodiment of the work cylinder 1, drain valve 12 configuration is disclosed having a simpler valve and passageway construction while still being disposed (similar to FIGS. 2 and 3) so that the second passageway 23 is adjacent the lowest point in the work cylinder 1 relative to the first pressure chamber 9. The embodiments of FIGS. 4 and 5 combine the functions of the pilot chamber 14 and the drain valve 12 with the second passageway 23 which, in this embodiment, is the pilot chamber 14.

As seen in FIG. 4, a retaining ring 45 is disposed in the second passageway 23 for the purpose of retaining a ball member 43 within the second passageway 23 when the first pressure chamber 9 is exhausted and the drain valve 12 is open. The ball member 43 serves as the valve body portion of the drain valve 12 which, in conjunction with a valve seat 42 formed in the second passageway 23, constitutes the drain valve 12.

A bias spring 41 acts on the ball member 43 in the same manner as the bias springs in the previous two embodiments; that is, the bias spring acts to push the ball member 43 off of the valve seat 42 when the fluid pressure in the first pressure chamber 9 is below a predetermined valve.

As shown in FIG. 4, the drain valve 12 is open and the ball member 43 is pressed partially against the retaining ring 45. The retaining ring 45, however, is constructed so that when the ball member 43 is resting partially against the retaining ring 45, fluid can still flow past the retaining ring 45 and ball member 43; that is, the ball member 43 resting on the retaining ring 45 does not seal off the second passageway 23.

A restriction area 44 is created in the second passageway 23 between the surface of the ball member 43 and the inner surface of the second passageway 23. The restriction area 44, which restricts flow from the first pressure chamber 9 to the opposite side of the ball member 43, creates a pressure-drop across the restriction. Therefore, pressure on the chamber side of the ball member 43 is greater than that on the spring side, and the ball member 43 is forced against the valve seat 42 when the pressure level in the first pressure chamber has exceeded the predetermined threshold level. When the drain level 12 has remained open because the fluid pressure in the first pressure chamber 9 has not yet reached the sufficient level, this initial fluid pressure assists in forcing moisture through the second passageway 23, past the retaining ring 45 and restriction area 44, through the open drain valve 12, and out the drain opening 40 which, in this instance, is disposed in a horizontal manner relative to the cylinder 4.

Figure 5:
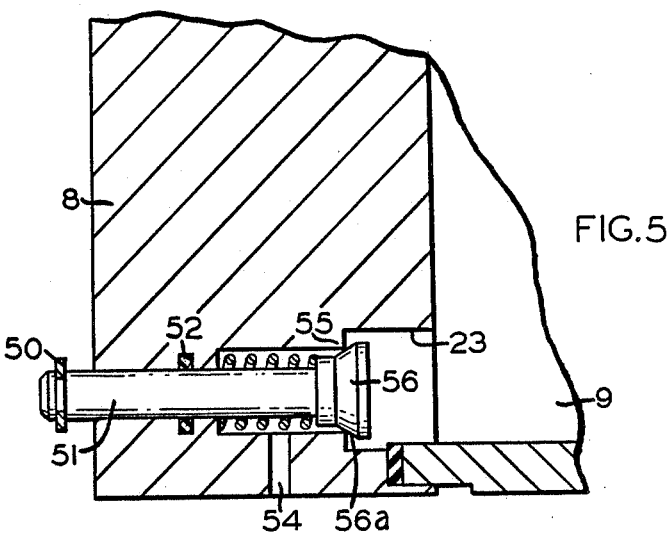
FIG. 5 is an elevational view, in section, of a third alternate embodiment of the drain valve portion of the work cylinder with the internally-disposed drain valve.

As seen in FIG. 5, another embodiment of the work cylinder 1, drain valve 12 configuration includes a plunger member 56 which has a plunger shaft portion 51, which extends outside of the first end cap member 8 and is retained from extending completely within the work cylinder 1 by a retaining ring 50, disposed around the circumference of the plunger shaft portion 51 which extends out of the work cylinder 1. A shaft seal 52 is disposed within the first end cap member 8, around a portion of the plunger shaft portion 51, to prevent leakage from around the plunger shaft portion 51.

As seen in FIG. 5, the plunger member 56 has a tapered head portion 56*a* which, together with a valve seat 55 formed at the end of the second passageway 23, constitutes the drain valve 12. Similar to the work cylinder 1, drain valve 12 configuration shown in FIG. 4, the one shown in FIG. 5 disposes the drain valve 12 in the second passageway 23 and accomplishes the pressure differential across the plunger member 56. The differential pressure across the axial direction of this plunger shaft portion 51 results from the pressure in the first pressure chamber 9 and second passageway 23 acting on the adjacent end of plunger member 56, and the atmospheric pressure acting on the opposite end of the plunger shaft portion 51 adjacent retaining ring 50. This establishes a higher pressure at the chamber side of the plunger shaft member 51. Also similar to the configuration shown in FIG. 4, the configuration shown in FIG. 5 disposes the drain valve horizontally in the work cylinder 1 relative to the longitudinal axis of the chamber.

As can be understood, the drain valve 12 or second passageway 23 may also be disposed in a vertical position in any manner convenient to permit easy gravity flow of liquid from the cylinder bore. As in all embodiments, the respective springs can be chosen to permit any pressure less than the full working pressure of the cylinder to operate the drain valve 12 to a closed position.

Although the hereinabove embodiments of the invention constitute preferred embodiments, it can be appreciated that modifications can be made thereto without departing from the scope of the invention as detailed in the appended claims.

I claim:

1. A work cylinder having an internally-disposed drain valve for purging moisture therefrom comprising:

(a) a housing having a bore formed coaxially therein;

(b) a piston, movable within said bore, divides said bore into a first and a second chamber;

(c) a pilot chamber formed in said housing adjacent one of said first and second chambers, and in fluid communication with said one of said first and second chambers through a first passageway;

(d) a plunger member movable within said pilot chamber to a first position when fluid pressure introduced to said one of said first and second chambers is communicated over said first passageway to one side of said plunger, said plunger further being movable to a second position when such fluid pressure introduced to said one of said first and second chambers is exhausted; and (e) said drain valve being disposed in said pilot chamber and being formed partially on said plunger member, said drain valve being operable to an open condition when said plunger member is in such second position such that moisture from said one of said first and second chambers can be drained to atmosphere, and said drain valve being further operable to a closed condition when said plunger member is in such first position whereby said drain valve is in a closed condition when said one of said first and second chambers is pressurized regardless of the pressure in the other of said first and second chambers.

2. A work cylinder, drain valve device, as set forth in claim 1, further comprising a second passageway means for fluid communication formed in said housing such that, said one of said first and second pressure chambers is connected to said pilot chamber at the lowest point of said one of said first and second pressure chambers.

3. A work cylinder, drain valve device, as set forth in claim 1, further comprising a bias spring disposed in said pilot chamber and in operative engagement with said plunger member such that, said plunger member is prevented from attaining such first position to close said drain valve until such fluid pressure introduced to said one of said first and second pressure chambers exceeds a predetermined threshold level.

4. A work cylinder, drain valve device, as set forth in claim 1, further comprising a retaining cap secured to one end of said housing adjacent and partially within said pilot chamber, said retaining cap being effective to enclose said pilot chamber at the lowest point of said housing and further having formed therein, a drain opening which, when said drain valve is in such open condition, allows moisture to be evacuated from said one of said first and second pressure chambers.

5. A work cylinder, drain valve device, as set forth in claim 4, wherein said drain valve includes a drain valve seat formed on said retaining cap adjacent said drain opening and a drain valve body formed by a lower tapered portion of said plunger member, said drain valve body seating on said drain valve seat to close said drain valve when said plunger member is in such first position.

6. A work cylinder, drain valve device, as set forth in claim 5, wherein said retaining cap has a tubular portion extending upward into said pilot chamber, said tubular portion having an inner bore in which a reduced-diameter lower portion of said plunger member slidably-fits in a guided, sealed manner.

7. A work cylinder, drain valve device, as set forth in claim 6, wherein said lower portion of said plunger member has a spring opening formed therein in which a bias spring seats, said bias spring being effective to urge said plunger member into such second position against the force exerted by such fluid pressure in said one of said first and second pressure chambers.

8. A work cylinder, drain valve device, as set forth in claim 2, wherein an upper surface area of said plunger member, exposed to such fluid pressure from said one of said first and second pressure chambers through said first passageway, is larger than a lower surface area of said plunger member exposed to such fluid pressure from said one of said first and second pressure chambers through said second passageway.

9. A work cylinder, drain valve device, as set forth in claim 2, further comprising a restriction formed in said second passageway to reduce the flow of such fluid pressure from said one of said first and second pressure chambers to a lower portion of said plunger member, thereby establishing a pressure differential across said plunger member in favor of an upper surface of said plunger member in communication with said one of said first and second pressure chambers over said first passageway.

10. A work cylinder, drain valve device, as set forth in claim 8, further comprising a bleed opening formed in one end of said housing such that, fluid pressure accumulating in a space between said upper surface of said plunger member and said lower surface of said plunger member can be evacuated therefrom.

11. A work cylinder, drain valve device, as set forth in claim 1, further comprising a second pilot chamber formed adjacent the other of said first and second pressure chambers as said one of said first and second pressure chambers; a second plunger member is disposed in said second pilot chamber; and a second drain valve, partially formed on said second plunger member, is operable to a first, closed condition when fluid pressure from said other of said first and second pressure chambers is communicated to an upper surface of said second plunger member, and said second drain valve is further operable to a second open condition when such fluid pressure from said other of said first and second pressure chambers is exhausted.

12. A work cylinder, drain valve device, as set forth in claim 1, wherein said plunger member is a ball element disposed within said first passageway, said ball being retained in said first passageway by a ring member which, when said ball element is in such second position, cooperates with said ball element to allow fluid to flow therethrough.

13. A work cylinder, drain valve device, as set forth in claim 12, wherein said ball element, when in such second position as corresponds to an open drain valve condition, acts as a restriction such that, the flow of fluid pressure therearound to a valve-side of said ball element is reduced in comparison to such fluid pressure from said one of said first and second pressure chambers as acts on a chamber-side of said ball element.

14. A work cylinder, drain valve device, as set forth in claim 13, further comprising a drain opening formed in said housing adjacent said drain chamber, said drain opening being disposed in said housing horizontally relative to the longitudinal axis of said housing.

15. A work cylinder, drain valve device, as set forth in claim 1, wherein said plunger member includes a plunger rod which extends outward of said housing, said plunger and plunger rod configuration being disposed in a horizontal manner relative to the longitudinal axis of said housing.

16. A work cylinder, drain valve device, as set forth in claim 2, further comprising a bias spring disposed in said pilot chamber and in operative engagement with said plunger member such that, said plunger member is prevented from attaining such first position to close said drain valve until such fluid pressure introduced to said one of said first and second pressure chambers exceeds a predetermined threshold level.

17. A work cylinder, drain valve device, as set forth in claim 16, further comprising a retaining cap secured to one end of said housing adjacent and partially within said pilot chamber, said retaining cap being effective to enclose said pilot chamber at the lowest point of said housing and further having formed therein, a drain opening which, when said drain valve is in such open condition, allows moisture to be evacuated from said one of said first and second pressure chambers.

18. A work cylinder, drain valve device, as set forth in claim 17, wherein said drain valve includes a drain valve seat formed on said retaining cap adjacent said drain opening and a drain valve body formed by a lower tapered portion of said plunger member, said drain valve body seating on said drain valve seat to close said drain valve when said plunger member is in such first position; and further wherein said retaining cap has a tubular portion extending upward into said drain chamber, said tubular portion having an inner bore in which a reduced-diameter lower portion of said plunger member slidably-fits in a guided, sealed manner.

19. A working cylinder, drain valve device, as set forth in claim 16, wherein said predetermined threshold level is a pressure less than the working pressure of said cylinder.

20. A working cylinder, drain valve device, as set forth in claim 3, wherein said predetermined threshold level is a pressure less than the working pressure of said cylinder.

* * * * *